US006848812B1

(12) United States Patent
Hsieh

(10) Patent No.: US 6,848,812 B1
(45) Date of Patent: Feb. 1, 2005

(54) LAMPSHADE ASSEMBLY

(75) Inventor: Duan-Cheng Hsieh, Taipei (TW)

(73) Assignee: Habitex Corporation, Taiwan (TW)

( * ) Notice: Subject to any disclaimer, the term of this patent is extended or adjusted under 35 U.S.C. 154(b) by 0 days.

(21) Appl. No.: 10/647,338

(22) Filed: Aug. 26, 2003

(51) Int. Cl.[7] ..... F21V 1/00

(52) U.S. Cl. ..... 362/362; 362/351; 362/249; 362/84

(58) Field of Search ..... 362/84, 351, 355, 362/360, 361, 294, 345, 346, 347

(56) References Cited

U.S. PATENT DOCUMENTS 5,947,590 A * 9/1999 Meuse et al. ..... 362/264
6,478,454 B1 * 11/2002 Jaffari et al. ..... 362/307
6,742,915 B1 * 6/2004 Westerheide ..... 362/360

* cited by examiner

*Primary Examiner*—Laura K. Tso
(74) *Attorney, Agent, or Firm*—Harness, Dickey & Pierce, P.L.C.

(57) ABSTRACT

A lampshade assembly that includes a main cover body and a reflector shroud. The main cover body is formed with a light emanating portion that defines at least one opening. The reflector shroud is mounted on the cover body, and is disposed surroundingly about and is spaced apart from the light emanating portion to define a heat dissipating space. The lampshade assembly further includes a mounting unit attached to the cover body to hold the shroud.

11 Claims, 8 Drawing Sheets

LAMPSHADE ASSEMBLY

BACKGROUND OF THE INVENTION

1. Field of the Invention

The invention relates to a lampshade assembly, more particularly to a lampshade assembly, which has a light emanating portion and a shroud covering the light emanating portion.

2. Description of the Related Art

A conventional lampshade 1 is shown in FIG. 1. The lampshade 1 has a cover body 10 with an open end 100. The lampshade 1 is applicable on a table lamp, a ceiling lamp, a wall lamp or a floor lamp. The cover body 10 is made of a non-transparent material so as to produce a gentle light output. However, the conventional lampshade 1 has, at least the following disadvantages:

1. Since light rays can emanate only from a forward end and a backward end of the lampshade 1, brightness is limited;
2. Heat of a light bulb is dissipated only through the open end 100 such that the heat dissipation effect is limited; and,
3. The color of the light produced from the lampshade 1 is attributed solely to the light bulb per se and cannot be altered and diversified.

SUMMARY OF THE INVENTION

Therefore, an object of the present invention is to provide a lampshade assembly that can dissipate heat effectively and that can add color to the monotonous light output of a light bulb mounted thereinside.

According to this invention, the lampshade assembly comprises a main cover body and a reflector shroud. The main cover body surrounds a receiving space, and is formed with a light emanating portion. The light emanating portion defines at least one opening. The reflector shroud is mounted on the cover body, and is disposed surroundingly about and is spaced apart from the light emanating portion to define a heat dissipating space.

BRIEF DESCRIPTION OF THE DRAWINGS

Other features and advantages of the present invention will become apparent in the following detailed is description of the preferred embodiments with reference to the accompanying drawings, of which.

DETAILED DESCRIPTION OF THE PREFERRED EMBODIMENTS

Figure 1:
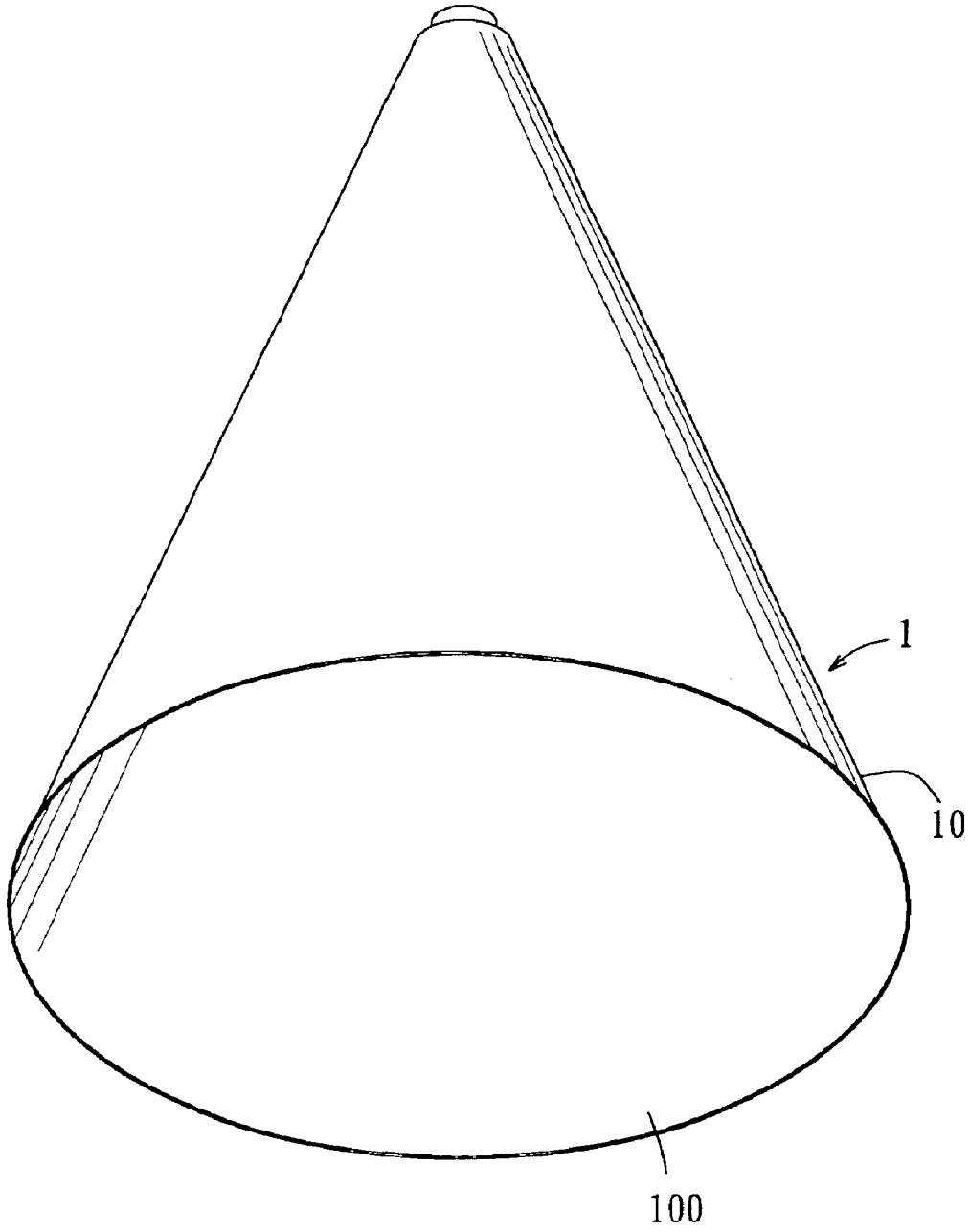
FIG. 1 PRIOR ART
FIG. 1 is a perspective view of a conventional lampshade.
Figure 2:
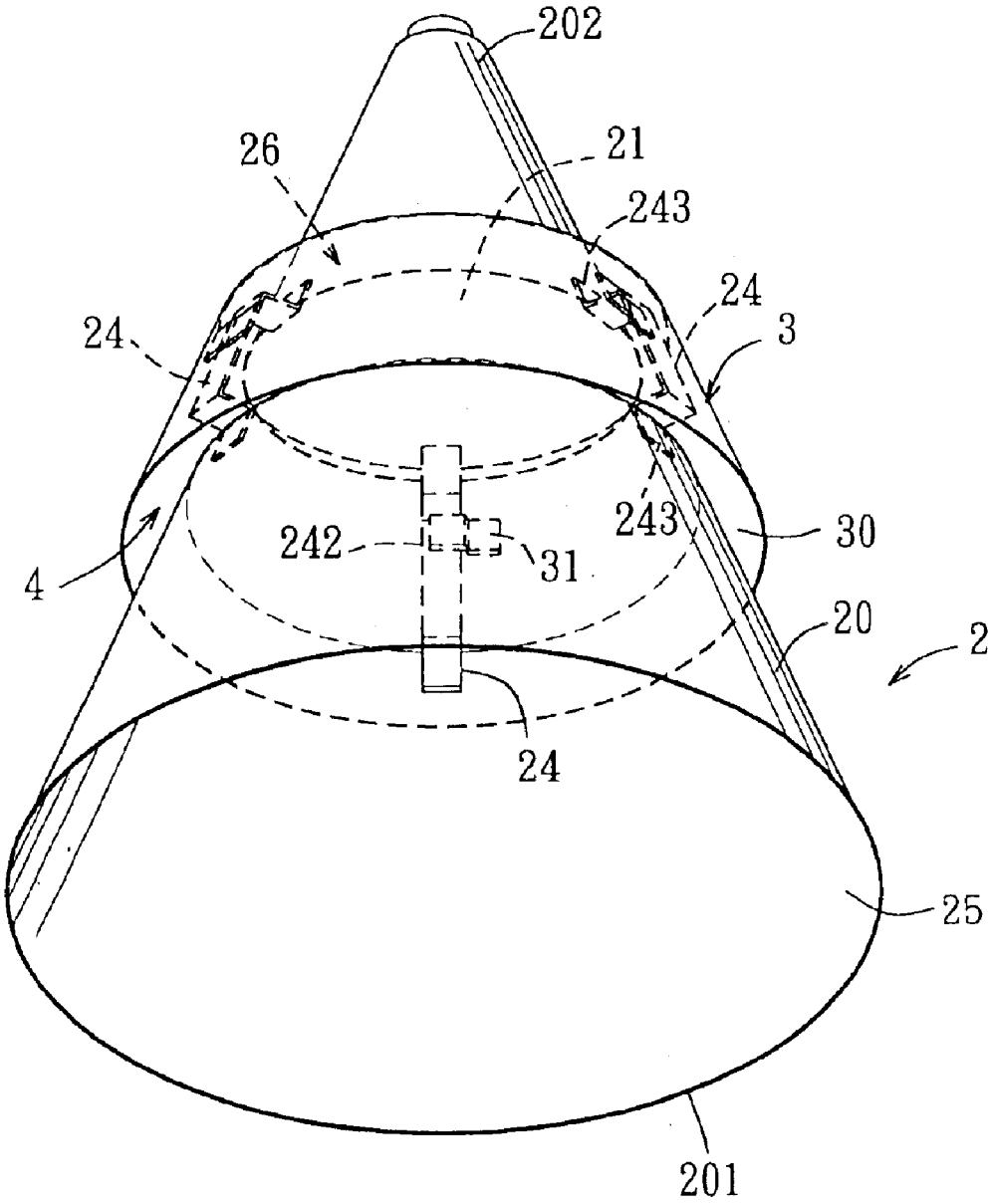
FIG. 2 is a perspective view of the first preferred embodiment of a lampshade assembly according to the present invention.
Figure 3:
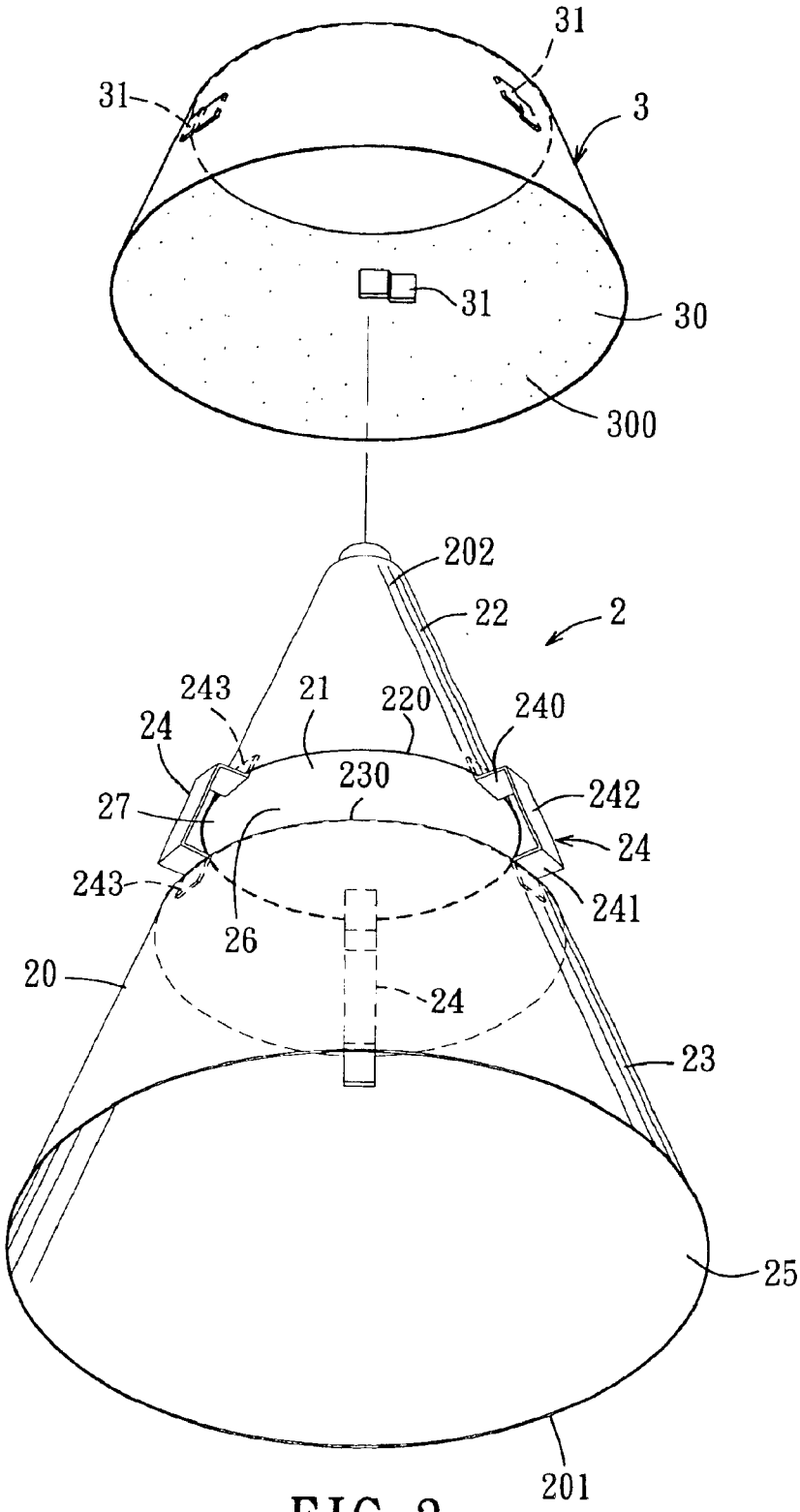
FIG. 3 is a partial exploded perspective view of a first preferred embodiment, illustrating a main cover body and a reflector shroud.

Before the present invention is described in greater detail, it should be noted that like elements are denoted by the same reference numerals throughout the disclosure.

Referring to FIGS. 2 to 6, the first preferred embodiment of a lampshade assembly according to the present invention is shown to comprise a main cover body 2, a mounting unit, and a reflector shroud 3.

The main cover body 2 surrounds a receiving space 25, and is formed with a light emanating portion 26. The cover body 2 has a cone-shaped wall 20 which includes a converging end 202, a diverging end 201, and an intermediate portion between the converging and diverging ends 202, 201. The light emanating portion 26 is disposed in the intermediate portion of the wall 20. The cover body 2 has a substantially cone-shaped first section 22 adjacent to the converging end 202, and a truncated cone-shaped second section 23 adjacent to the diverging end 201 and spaced apart from the first section 22. The light emanating portion 26 is defined by an opening 21 between the first and second sections 22, 23. Thus, the opening 21 is substantially ring-shaped.

The mounting unit is attached to the cover body 2 to hold the shroud 3, and includes three mounting elements 24, each of which has an inner end secured to the cover body 2 and extends outwardly from the inner end to connect with the shroud 3. Specifically, each mounting element 24 includes a U-shaped member which has a bight portion 242 extending across the opening 21, two opposed arms 240, 241 extending respectively and inwardly from two ends of the bight portion 242, and two end flanges 243 extending respectively from the arms 240, 241 in opposite directions away from the arms 240, 241. The flanges 243 are secured respectively to the peripheral ends 220, 230 of the first and second sections 22, 23 proximate to the opening 21 by a welding process. The bight portion 242 is spaced apart from the light emanating portion 26 by a suitable gap 27, and is generally parallel to the wall 20 of the cover body 2, as shown by the arrow 28 in FIG. 4.

Figure 4:
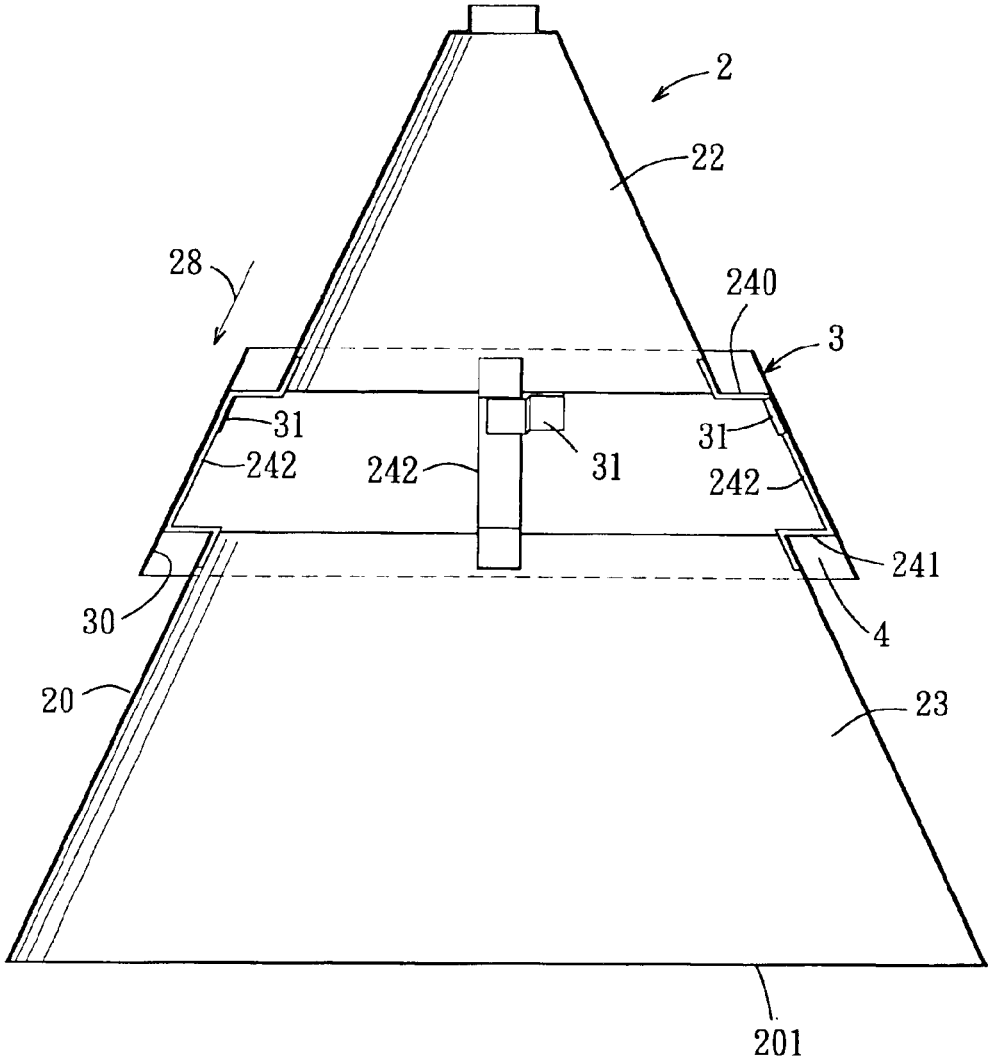
FIG. 4 is a schematic view of the first preferred embodiment in an assembled state.
Figure 5:
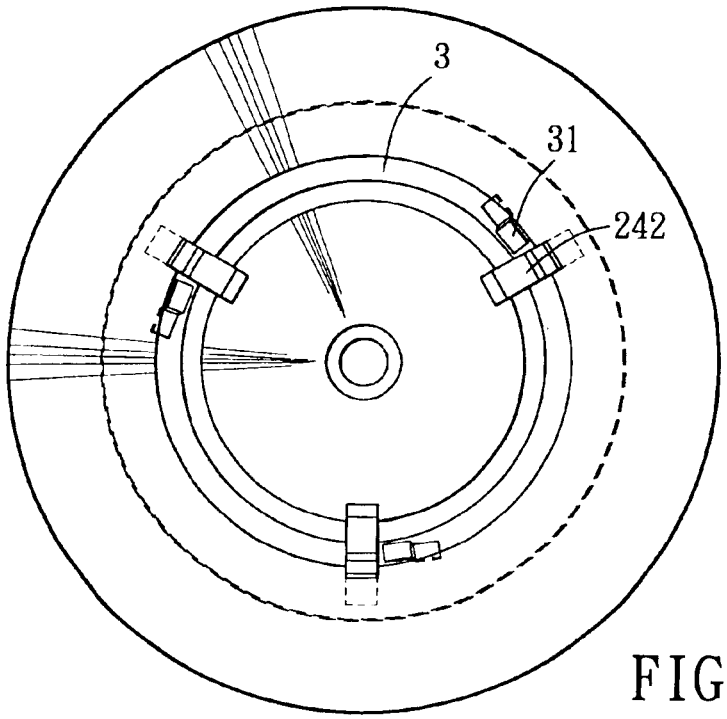
FIG. 5 is a schematic view of the first preferred embodiment, illustrating the reflector shroud prior to engagement with the cover body.
Figure 6:
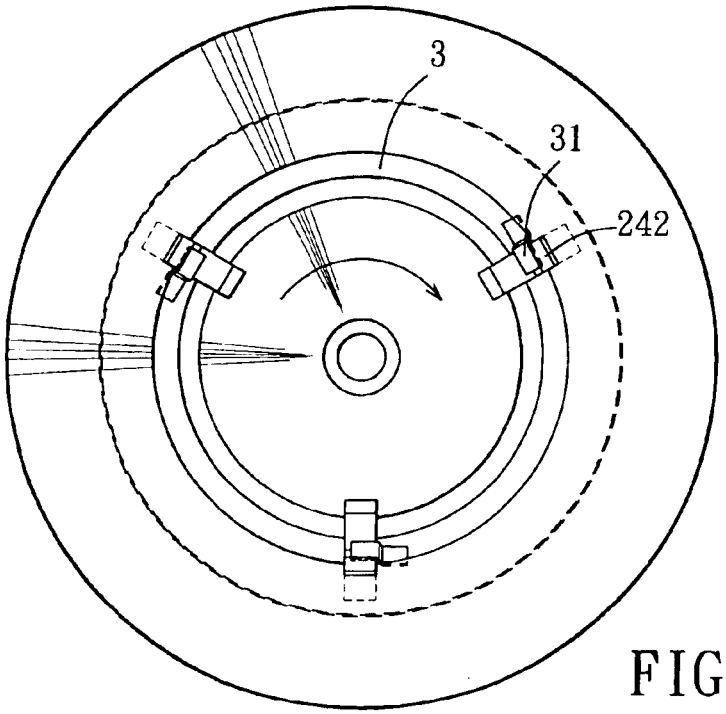
FIG. 6 is a schematic view of the first preferred embodiment, illustrating the reflector shroud after engagement with the cover body.

The reflector shroud 3 is mounted on the cover body 2 using the mounting elements 24, and is disposed surroundingly about and spaced apart from the light emanating portion 26 to define a heat dissipating space 4 (see FIG. 4). The shroud 3 has a truncated cone-shape, and has an inner surface 30 formed with three positioning hooks 31 that engage the respective bight portions 242 of the mounting elements 24. Generally, the number of the positioning hooks 31 corresponds to the number of the bight portions 242 of the mounting elements 24. The positioning hooks 31 engage the respective bight portions 242 of the mounting elements 24 by rotating the shroud 3 relative to the cover body 2, as shown in FIGS. 5 and 6, so that the shroud 3 is positioned on the cover body 2 (see FIGS. 2 and 4), thereby forming the heat dissipating space 4 between the inner surface 30 of the shroud 3 and the light emanating portion 26 of the cover body 2.

When light rays are produced from a light bulb (not shown) in the cover body 2, the light rays not only radiate from the diverging end 201 of the cover body 2, but also from the light emanating portion 26 and the heat dissipating space 4. The light emanating portion 26 can dissipate heat generated by the light bulb through the heat dissipating space 4, thereby enhancing the heat dissipating effect of the lampshade assembly of the present invention.

On the other hand, the inner surface 30 of the shroud 3 may be coated with a heat-resistant pigment layer, or heat-resistant fluorescent pigment layer 300. The color of the light bulb may be yellowish or white. When the light rays from the light bulb emanate from the opening 21, the color thereof is altered as it is mixed with the color of the heat resistant pigment layer or the heat resistant fluorescent pigment layer 300. When the mixed colors of the light are reflected and redirected outward by the shroud 3, amore pleasant color effect is produced.

Figure 7:
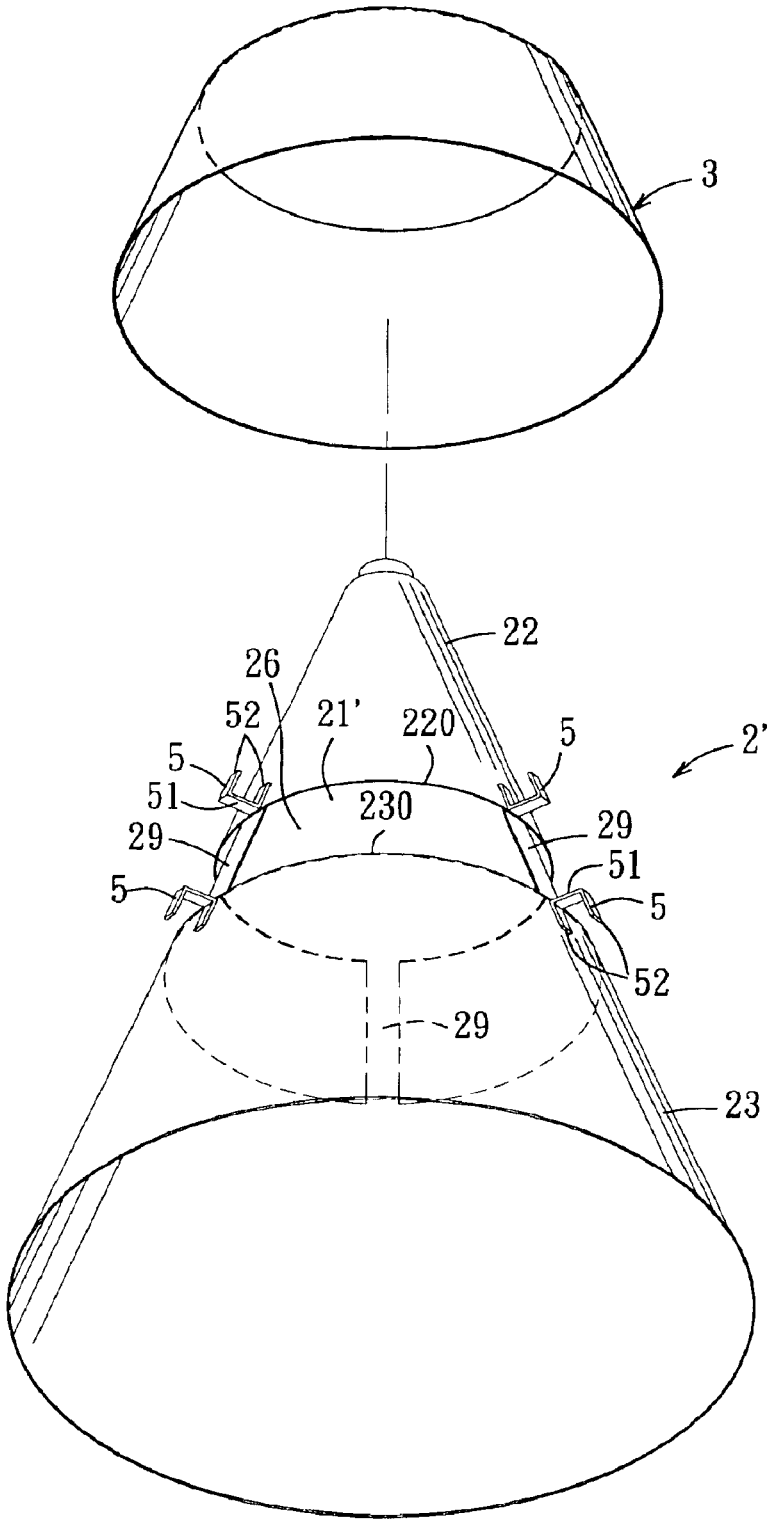
FIG. 7 is an exploded perspective view of a second preferred embodiment of a lampshade assembly according to the present invention.

FIG. 7 illustrates the second preferred embodiment of a lampshade assembly according to the present invention, which is substantially similar to the first preferred embodiment. However, in this embodiment, the main cover body 2' further includes three spaced-apart strips 29 connected to and cooperating with the peripheral ends 220, 230 of the first and second sections 22, 23 to define three annularly spaced-apart openings 21' in the light emanating portion 26 of the cover body 2'. The inner surface 30 of the shroud 3 is not formed with positioning hooks in this embodiment. Each of the mounting elements includes a U-shaped member 5 secured to the peripheral end 220, 230 of one of the first and second sections 22, 23. The U-shaped member 5 has a bight portion 51 and two opposite arms 52 projecting from the bight portion 51. One of the arms 52 is secured to one of the first and second sections 22, 23, whereas the other one of the arms 52 is connected to the inner surface 30 of the shroud 3 by a welding process so as to position the shroud 3 on the main cover body 2'. The main cover body 2' has a similar effect as that of the cover body 2 of the first preferred embodiment shown in FIG. 2.

Figure 8:
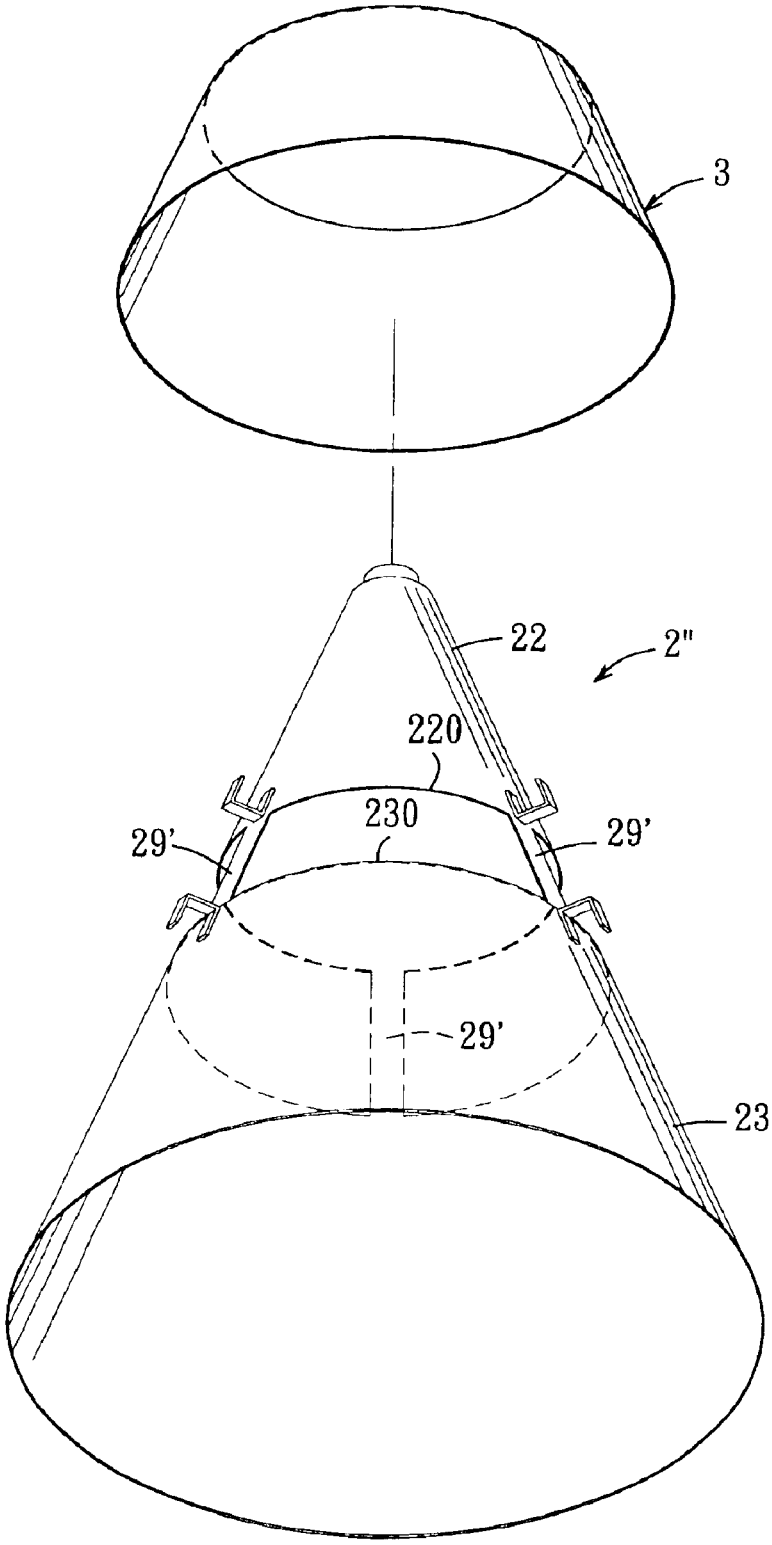
FIG. 8 is an exploded perspective view of a third preferred embodiment of a lampshade assembly according to the present invention.

Referring to FIG. 8, the third preferred embodiment of a lampshade assembly according to the present invention is shown and is substantially similar to the second preferred embodiment. However, in this embodiment, the strips 29' are integrally formed with the peripheral ends 220, 230 of the first and second sections 22, 23 of the main cover body 2".

Figure 9:
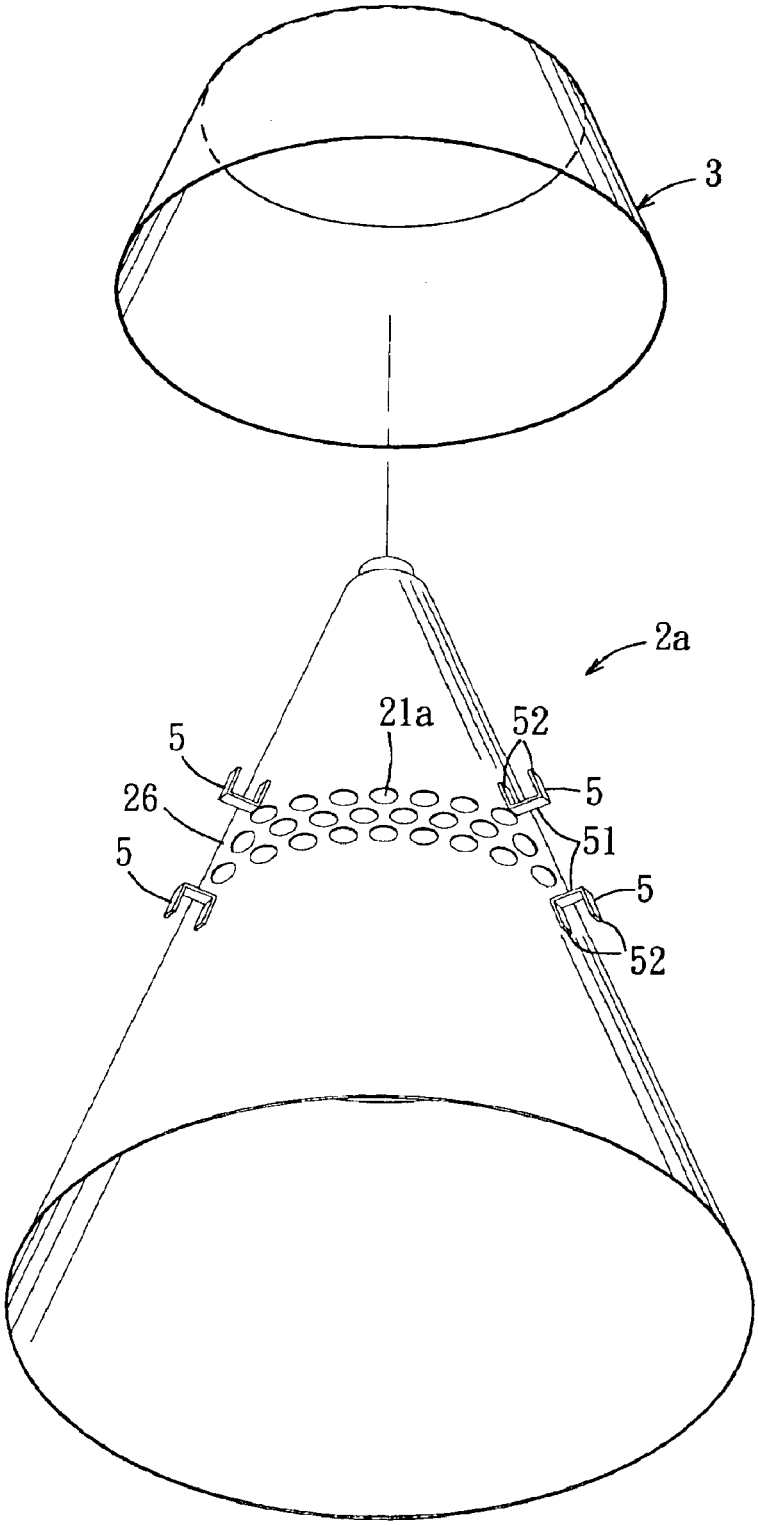
FIG. 9 is an exploded perspective view of a fourth preferred embodiment of a lampshade assembly according to the present invention.

Referring to FIG. 9, the fourth preferred embodiment of a lampshade assembly according to the present invention is shown and is substantially similar to the third preferred embodiment. However, in this embodiment, the main cover body 2*a* is a one-piece body. The light emanating portion 26 includes a plurality of openings 21*a*. Each of the mounting elements includes a pair of spaced-apart U-shaped members 5 secured to the light emanating portion 26. Each U-shaped member 5 has a bight portion 51 and two opposite arms 52 projecting from the bight portion 51. One of the arms 52 is secured to the light emanating portion 26, whereas the other one of the arms 52 is connected to the shroud 3. The advantages of the first preferred embodiment can be similarly attained by the fourth preferred embodiment.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A lampshade assembly comprising:

a main cover body surrounding a receiving space and formed with a light emanating portion, said light emanating portion defining at least one opening; and a reflector shroud mounted on said cover body, said shroud being disposed surroundingly about and being spaced apart from said light emanating portion to define a heat dissipating space, said main cover body having a cone-shaped wall which includes a converging end, a diverging end, and an intermediate portion, said light emanating portion being disposed in said intermediate portion.

2. The lampshade assembly as claimed in claim 1, further comprising a mounting unit attached to said cover body to hold said shroud, said mounting unit including a plurality of mounting elements, each of which has an inner end secured to said cover body and extends outwardly from said inner end to connect with said shroud.

3. The lampshade as claimed in claim 2, wherein said cover body has a substantially cone-shaped first section, and a truncated cone-shaped second section which is spaced apart from said first section, said opening being disposed between said first and second sections.

4. The lampshade as claimed in claim 3, wherein each of said mounting elements includes a U-shaped member which has a bight portion extending across said opening, and two opposed arms extending respectively and inwardly from two ends of said bight portion, said arms being secured respectively to said first and second sections.

5. The lampshade as claimed in claim 4, wherein said shroud has a truncated cone-shape and has an inner surface formed with a positioning hook to engage said bight portion.

6. The lampshade as claimed in claim 3, wherein said main cover body further includes a plurality of spaced-apart strips which extend across said opening.

7. The lampshade assembly as claimed in claim 6, wherein each of said mounting elements includes a U-shaped member secured to each of said first and second sections proximate to said opening, said U-shaped member having a bight portion and two opposite arms projecting from said bight portion, one of said arms being secured to one of said first and second sections, the other one of said arms being connected to said shroud.

8. The lampshade assembly as claimed in claim 2, wherein said main cover body is a one-piece body, said light emanating portion defining a plurality of said openings.

9. The lampshade assembly as claimed in claim 8, wherein each of said mounting elements includes a U-shaped member secured to said light emanating portion, said U-shaped member having a bight portion and two opposite arms projecting from said bight portion, one of said arms being secured to said light emanating portion, the other one of said arms being connected to said shroud.

10. A lampshade assembly comprising:

a main cover body surrounding a receiving space and formed with a light emanating portion, said light emanating portion defining at least one opening; and a reflector shroud mounted on said cover body, said shroud being disposed surroundingly about and being spaced apart from said light emanating portion to define a heat dissipating space wherein an inner surface of said shroud is coated with a heat resistant pigment layer.

11. The lampshade assembly as claimed in claim 10, wherein said pigment layer is a fluorescent pigment.

* * * * *